United States Patent [19]

Rothfuss

[11] Patent Number: 4,789,086

[45] Date of Patent: Dec. 6, 1988

[54] REFRACTORY WEAR PARTS FOR SLIDING CLOSURE UNITS

[75] Inventor: Hans Rothfuss, Taunusstein, Fed. Rep. of Germany

[73] Assignee: Didier-Werke AG, Wiesbaden, Fed. Rep. of Germany

[21] Appl. No.: 167,156

[22] Filed: Mar. 16, 1988

[30] Foreign Application Priority Data

May 2, 1987 [DE] Fed. Rep. of Germany ..... 3714680

[51] Int. Cl.[4] ..... B22D 37/00

[52] U.S. Cl. ..... 222/603; 266/220; 266/236

[58] Field of Search ..... 222/603; 266/220, 236

[56] References Cited

U.S. PATENT DOCUMENTS

| | | | |
|---|---|---|---|
| 3,838,798 | 10/1974 | Voss | 222/603 |
| 4,179,046 | 12/1979 | Jeschke et al. | 222/603 |
| 4,365,731 | 12/1982 | Fehling et al. | 222/603 |
| 4,583,721 | 4/1986 | Arakawa et al. | 266/220 |
| 4,746,038 | 5/1988 | Ohwada et al. | 222/603 |

FOREIGN PATENT DOCUMENTS

| | | | |
|---|---|---|---|
| 2702436 | 7/1977 | Fed. Rep. of Germany . | |
| 3406076 | 5/1985 | Fed. Rep. of Germany . . | |
| 21533 | 7/1979 | Japan | 266/236 |

*Primary Examiner*—L. Dewayne Rutledge
*Assistant Examiner*—Robert L. McDowell
*Attorney, Agent, or Firm*—Wenderoth, Lind & Ponack

[57] ABSTRACT

A refractory wear part for use in a sliding closure unit for a metallurgical vessel has therethrough at least one flow-through opening. The wear part is formed of a combination of gas permeable material and gas impervious material. The wear part includes at least one gas flushing zone formed of the gas permeable material and opening on a surface of the wear part. A gas duct connects the flushing zone with an external gas inlet connection. The gas duct and the flushing zone are formed as a unitary, homogeneous gas permeable structure from the gas permeable material, and such gas permeable structure is formed within a gas impervious base structure formed of the gas impervious material.

7 Claims, 1 Drawing Sheet

REFRACTORY WEAR PARTS FOR SLIDING CLOSURE UNITS

BACKGROUND OF THE INVENTION

The present invention relates to refractory wear parts for use in sliding closure units for metallurgical vessels. More particularly, the present invention relates to such a refractory wear part having therethrough at least one flow-through opening, the wear part being formed of a combination of gas permeable material and gas impervious or impermeable material, with at least one zone formed of the gas permeable material and opening on the surface of the wear part for supplying thereto a gas, for example a flushing, scavenging or other gas for purposes as would be understood by those skilled in the art. This zone, hereinafter referred to as a flushing zone, is connected with an external gas inlet connection by a gas duct. The present invention particularly is directed to a wear plate, such as a stationary or sliding plate having at least one sliding surface.

DE-OS No. 34 06 076 discloses a refractory bottom or stationary plate formed of a main body of refractory gas permeable or porous material and a sliding surface section or zone formed of gas impervious refractory material. A gas chamber is formed within the porous main body around the flow-through opening by means of substances that burn out during firing. After firing, a gas duct is drilled through the plate to connect with the gas chamber, and such gas duct is provided with a gas inlet connection. In order for gas issuing from the gas chamber to reach the flow-through opening through pours in the porous main body, while preventing the gas from escaping through the free surfaces of the main body, such free surfaces are sealed in a gas tight manner by means of a refractory glaze. Due to the unequal strengths of the main body and of the sliding surface section, this known plate is barely capable of satisfactorily withstanding the thermal shock and bending stresses to which the plate is subjected during use. Moreover, the necessity of forming bores in the plate weakens the stability of the plate and increases the cost thereof. The necessity of the provision of the sealing glaze further increases the cost of the plate.

SUMMARY OF THE INVENTION

Accordingly, it is an object of the present invention to provide an improved refractory wear part of the general type mentioned initially, but whereby it is possible to overcome the above and other prior art disadvantages.

It is a more specific object of the present invention to provide such an improved refractory wear part, particularly a wear plate, having an improved arrangement of flushing zones formed of gas porous or permeable material and used for the conduction of gases.

It is a yet further object of the present invention to provide such a wear part that is improved in terms of construction and manufacture.

The above and other objects of the present invention are achieved by the formation of the zone of the gas duct and the flushing zone or zones as a unitary, homogeneous gas permeable structure formed from the gas permeable material, and by forming this gas permeable structure within a gas impervious base structure formed of the gas impervious material. As a result, the wear parts, and particularly the stationary or movable sliding wear plates, include a type of sandwich construction including stiffened planar surfaces formed of the impervious material and between which the gas permeable structure is positioned as an elastic core layer. This makes the wear plate lighter and also more resistant to bending stresses and thus less susceptible to being broken during use. Furthermore, due to the simultaneous use of the gas permeable structure for purposes both of gas conduction and gas flushing, the wear parts can be made less expensively. Thus, during forming of, for example, a wear plate, the flushing system is completely formed within the plate without the necessity of post drilling operations to form gas ducts. In addition, it is possible to form the flushing zones needed on particular wear parts in accordance with any particular design and arrangement. That is, the flushing zones can be easily arranged to meet particular practical requirements. This is due to the fact that the internal permeable structure for the supply of gas and for the flushing zones can be designed to fit any surface configuration or section.

Depending upon the design, particularly of the gas duct zone, it may be advantageous to provide within the gas permeable structure embedded within the base structure, at a position upstream of the flushing zones, open spaces free of the gas permeable material nd the gas impervious material. Such open or free spaces can serve for the collection and even distribution of the gas to the flushing zones.

In accordance with another feature of the present invention wherein the wear part is in the form of a wear plate, the gas permeable structure includes the gas duct zone and a plurality of flushing zones formed integrally therewith. In such a case it is advantageous for the plurality of flushing zones to include a sleeve-shaped flushing zone surrounding the flow-through opening and opening onto the surface thereof, a plug-shaped or stopper-shaped flushing zone opening onto a sliding surface of the wear plate, and an annular flushing zone opening onto the sliding surface. This arrangement has particular applicability to a movable wear plate. For a stationary wear plate, it is not necessary to provide the plug-shaped flushing zone. It also is possible to provide a stationary plate without the annular flushing zone.

As a rule, it is advisable to design the gas duct zone or zones as a straight supply duct having a rectangular cross section. However, particularly for movable plates employed in installations with a high rate of flushing gas consumption, it is of advantage to provide the gas permeable structure having a shape generally corresponding to the shape of the plate but of a reduced size within the gas impervious structure. This thereby forms a gas chamber zone that is integral with all of the flushing zones and that is connected to or forms the gas duct zone. Such an arrangement results in relatively short gas paths and provides space for a reliable supply of the required quantities of gas to the various flushing zones.

With regard to the formation or build-up of the gas permeable structure and the gas impervious base structure, it is possible to achieve the desired degrees of gas permeability and gas imperviousness by the use of different forming pressures of an appropriately homogeneous refractory raw material. It is also possible in accordance with the present invention to achieve the desired degrees of permeability and imperviousness by the use of differing range sizes of raw materials for the permeable structure and for the base structure. This arrangement particularly facilitates a speedy fabrication of the wear parts.

BRIEF DESCRIPTION OF THE DRAWINGS

Other objects, features and advantages of the present invention will be described in more detail below with reference to the accompanying drawings, wherein.

DETAILED DESCRIPTION OF THE INVENTION

Figure 1:
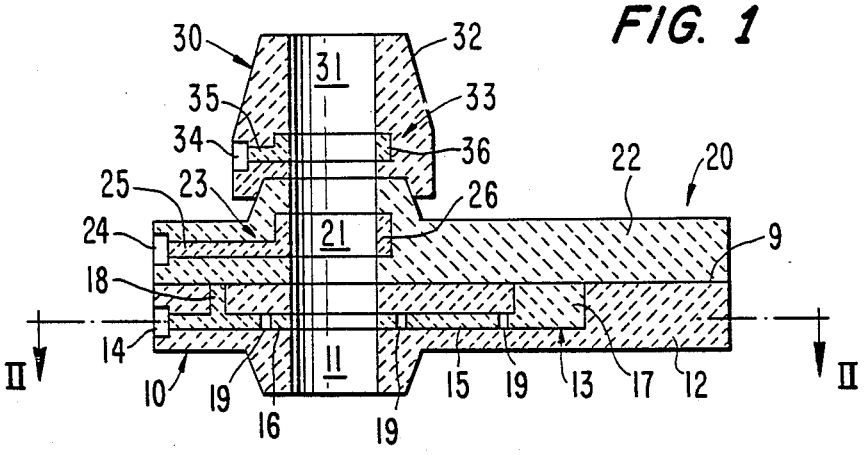
FIG. 1 is a longitudinal section through refractory wear parts of a linearly movable two-plate sliding closure unit and formed in accordance with the present invention.
Figure 3:
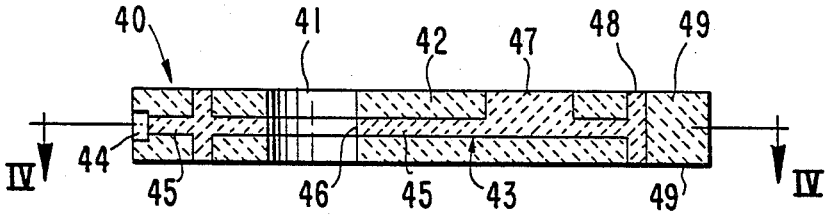
FIG. 3 is a longitudinal section through the movable central plate of a three-plate sliding closure unit and formed according to another arrangement of the present invention.

FIG. 1 shows wear parts employed with a two-plate sliding closure unit and including nozzle sleeve 30, stationary bottom plate 20, and movable sliding plate 10 adapted to be moved in opposite linear directions in a manner known in the art. FIG. 3 shows a movable sliding central plate intended to be employed in a three-plate sliding closure unit in a manner known in the art.

All of the wear components including movable plate 10, stationary plate 20, nozzle sleeve 30 and movable plate 40 are provided with respective flow-through openings 11, 21, 31, 41 and are ceramic products formed of a combination of gas impervious refractory material and gas permeable refractory material.

More particularly, in accordance with the present invention the gas impervious material forms a base structure 12, 22, 32, 42 into which a gas permeable structure is embedded. Each such gas permeable structure includes at least one gas duct zone 15, 25, 35, 45 provided with an external gas inlet connection 14, 24, 34, 44 and communicating with one or more flushing zones which discharge onto or open onto various surfaces of the respective wear parts.

Figure 2:
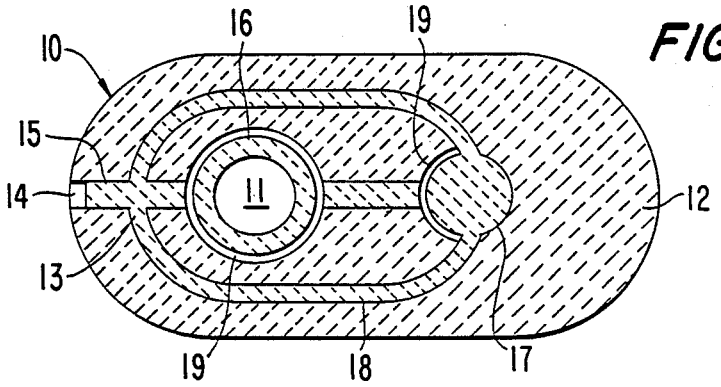
FIG. 2 is a cross-sectional view taken along line II—II of FIG. 1.

More particularly, in the embodiment shown in FIGS. 1 and 2, the base structure 12 of movable plate 10 has formed or embedded therein, at a level approximately midway of the thickness thereof, a unitary, homogeneous gas permeable structure formed of the gas permeable material and including gas duct zone 15, sleeve-shaped flushing zone 16 surrounding flow-through opening 11 and opening or discharging onto the surface thereof, a stopper-shaped or plug-shaped flushing zone 17 that opens onto sliding surface 9 of the plate, and an annular flushing zone 18 which also opens onto sliding surface 9. Open spaces 19, free of both the gas permeable material and the gas impervious material, are located between the gas duct zone 15 and the flushing zones 16–18.

As can best be seen in FIG. 2, flushing gas supplied through gas inlet connection 14 fills up the open pores in the gas permeable structure 13 and the open spaces 19, after which the gas emerges from sleeve-shaped flushing zone 16 to flow into the flow-through opening 11, for example so as to prevent the formation therein of any metal deposits. At the same time, the gas flows from the stopper-shaped flushing zone 17 and the annular flushing zone 18 onto sliding surface 9 between the two plates 10, 20. Thereby, a film of flushing gas is supplied between the two plates to improve the sliding capacity of the plates and also to prevent reoxidizing external air from being sucked into the stream of molten flowing through the flow-through openings 11, 21, 31.

In the closed position of the plate 10 the stopper-shaped flushing zone 17 is located below the flow-through opening 21 in bottom plate 20, so that an ascending stream of flushing gas maintains the molten metal in the flow-through openings 21, 31 flowable and self-fluxing until the next operation of opening movement of plate 10. This effect also is aided or supported by gas permeable structures 23, 33 provided in stationary bottom plate 20 and in nozzle sleeve 30. These gas permeable structures include gas duct zones 25, 35 and flushing zones 26, 36 to thereby supply flushing gas to the flow-through openings 21, 31. Although FIG. 1 does not so illustrate, it also is possible to supply a flushing gas to the bottom sliding surface of plate 20 by means of an annular flushing zone similar to zone 18 in plate 10, but a mirror image thereof. It of course would not be necessary to provide a stopper-shaped flushing zone in such an arrangement of stationary plate 20.

Figure 4:
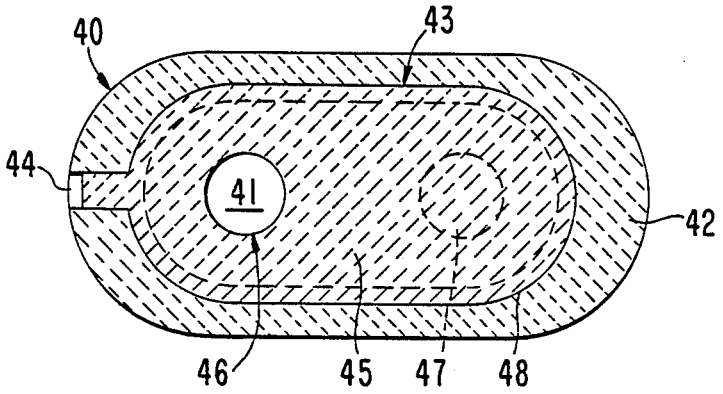
FIG. 4 is a cross-sectional view taken along line IV—IV of FIG. 3.

In the embodiment of FIGS. 3 and 4, central movable plate 40 cooperates with two stationary plates, one located above and one located below and has two parallel sliding surfaces 49. Thus, the gas permeable structure 43 includes two annular flushing zones 48, one opening upwardly and one opening downwardly. Additionally however, FIGS. 3 and 4 illustrate a further embodiment of the present invention wherein the gas permeable structure 43 has a generally planar shape similar to that of the shape of plate 40 but of a reduced size. This shape forms a large gas duct zone 45 integral with the inlet gas duct zone, with a sleeve-shaped flushing zone 46, a stopper-shaped flushing zone 47 and the annular flushing zone 48. This increased volume gas permeable structure 43 forms a pressure reservoir for the flushing gas to achieve a uniform pressure admission of the gas to the flushing zones 46, 47, 48.

Plate 40 may be formed of suitable refractory raw materials as would be understood by one skilled in the art, for example MgO, $Al_2O_3$ or $SiO_2$, in two classes of grain sizes such as listed below for the gas permeable material and for the gas impervious material;

| Grain Sizes | Impervious Material | Permeable Material |
|---|---|---|
| >1 mm | 7% | 15% |
| 0.1–1 mm | 23% | 67% |
| 0.09–0.5 mm | 30% | 11% |
| <0.09 mm | 40% | 7% |

From these materials, single shapes are first preformed under light pressure from the gas permeable material. For example, first a prefabricated annular piece is positioned in a die to form the annular flushing zone 48 for one sliding surface 49 up to the height of the underside of the zone 45. Then, impervious material is filled in to an equal level and, together with the above mentioned annular piece, is subjected to light pressure. On the resultant smooth planar surface is laid the prefabricated laminar zone 45 which itself serves as a bearing surface for the remainder of the annular piece of the annular flushing zone 48 and of the stopper-shaped flushing zone 47. Again, impervious material is added to an equal level, after which the final molding operation is carried out with a compressive force of, for example, 100 to 120 $N/mm^2$. Finally, the plate 40 is fired at a temperature that will result in suitable ceramic bonding.

The same or similar procedures, as would be understood by one skilled in the art, may be adapted to fabricate the movable plate 10, the stationary plate 20 and the nozzle sleeve 30. However, particularly for the fabrication of movable plate 10, it is possible to achieve preforming with a press die (female mold) that carries the mating form of the gas permeable structure 13, with the side of the sliding surface of plate 10 lying on the bottom of the mold. In such a process the profile of the gas permeable structure is stripped. The resultant profile recess then is filled with permeable material and covered with the remaining impervious material, so that the plate 10 can be obtained by a second pressing operation. In both methods of fabrication of plate 10, the open spaces 19 can be achieved by embedding appropriately profiled cores that evaporate during firing of the plate.

It is to be understood that the invention described herein may be applied to plates, particularly movable plates, with different geometrical designs than specifically described and illustrated, for example, plates for rotary or swivel sliding closure units. Furthermore, an outlet nozzle or sleeve can be formed according to the present invention, even though such a structural element is not shown in the drawings for the sake of simplicity. One skilled in the art readily would understand the configuration and placement of such an additional element.

Although the present invention has been described and illustrated with respect to preferred features thereof, it is to be understood that various changes and modifications may be made to the specifically described and illustrated features without departing from the scope of the present invention.

I claim:

1. In a refractory wear part for use in a sliding closure unit for a metallurgical vessel, said wear part having therethrough at least one flow-through opening, said wear part being formed of a combination of gas permeable material and gas impervious material, and said wear part including at least one gas flushing zone formed of said gas permeable material and opening on a surface of said wear part, and a gas duct connecting said flushing zone with an external gas inlet connection, so that gas may be supplied through said flushing zone to said surface of said wear part, the improvement wherein:

said gas duct and said at least one flushing zone are formed as a unitary, homogeneous gas permeable structure from said gas permeable material; and said gas permeable structure is formed within a gas impervious base structure formed of said gas impervious material.

2. The improvement claimed in claim 1, wherein said flushing zone comprises a sleeve-shaped zone surrounding said flow-through opening and opening on the surface thereof.

3. The improvement claimed in claim 1, further comprising an open space, free of said gas permeable material and said gas impervious material, between the zone of said gas duct and said flushing zone.

4. The improvement claimed in claim 1, wherein said wear part comprises a plate having at least one planar sliding surface, and said gas permeable structure comprises a plurality of flushing zones.

5. The improvement claimed in claim 4, wherein said plurality of flushing zones comprise a sleeve-shaped flushing zone surrounding said flow-through opening and opening on the surface thereof, a plug-shaped flushing zone opening on said sliding surface, and an annular flushing zone opening on said sliding surface.

6. The improvement claimed in claim 5, wherein said plate has two parallel planar sliding surfaces, and said annular flushing zone opens on both said sliding surfaces.

7. The improvement claimed in claim 5, wherein said gas permeable structure includes a gas chamber zone having a shape corresponding to said plate but of reduced size, and said gas chamber zone is integral with all of said flushing zones.

* * * * *